US008418887B2

(12) United States Patent
Milian et al.

(10) Patent No.: US 8,418,887 B2
(45) Date of Patent: Apr. 16, 2013

(54) FLUID PRODUCT DISPENSER

(75) Inventors: Alex Milian, Les Baux Debreteuil (FR); Florent Pouliaude, Thuit Signol (FR)

(73) Assignee: Aptar France SAS, Le Neubourg (FR)

( * ) Notice: Subject to any disclaimer, the term of this patent is extended or adjusted under 35 U.S.C. 154(b) by 798 days.

(21) Appl. No.: 12/519,471

(22) PCT Filed: Dec. 13, 2007

(86) PCT No.: PCT/FR2007/052504

§ 371 (c)(1),
(2), (4) Date: Jun. 16, 2009

(87) PCT Pub. No.: WO2008/078045

PCT Pub. Date: Jul. 3, 2008

(65) Prior Publication Data

US 2010/0044394 A1 Feb. 25, 2010

(30) Foreign Application Priority Data

Dec. 18, 2006 (FR) ..... 06 55596

(51) Int. Cl.
*B67D 7/70* (2010.01)

(52) U.S. Cl.
USPC ..... 222/137; 222/153.13; 222/309

(58) Field of Classification Search ..... 222/137, 222/153.13, 250, 282, 283, 309
See application file for complete search history.

(56) References Cited

U.S. PATENT DOCUMENTS

| | | | | |
|---|---|---|---|---|
| 4,006,841 | A * | 2/1977 | Alticosalian | 222/42 |
| 5,363,992 | A * | 11/1994 | Meshberg | 222/309 |
| 5,411,176 | A * | 5/1995 | Favre | 222/94 |
| 5,833,121 | A * | 11/1998 | Gueret | 222/144.5 |
| 5,971,210 | A * | 10/1999 | Brugger | 222/137 |
| 5,971,230 | A | 10/1999 | Tanaka | |
| 6,464,107 | B1 * | 10/2002 | Brugger | 222/134 |
| 6,945,430 | B2 * | 9/2005 | Bloc | 222/135 |
| 7,222,752 | B2 * | 5/2007 | Ponton | 222/134 |
| 2004/0251274 | A1 * | 12/2004 | Ponton | 222/134 |

FOREIGN PATENT DOCUMENTS

| | | | |
|---|---|---|---|
| FR | 2 569 581 | A1 | 3/1986 |
| FR | 2 654 016 | A1 | 5/1991 |
| FR | 2 658 486 | A1 | 8/1991 |
| WO | 97/07383 | A1 | 2/1997 |

* cited by examiner

*Primary Examiner* — Kevin P Shaver
*Assistant Examiner* — Daniel R Shearer
(74) *Attorney, Agent, or Firm* — Sughrue Mion, PLLC

(57) ABSTRACT

A fluid dispenser comprising: at least one fluid reservoir (1*a*, 1*b*) provided with an opening (11*a*, 11*b*); at least one fluid dispenser member (3*a*, 3*b*), such as a pump or a valve, comprising a body (31*a*, 31*b*) that is mounted in stationary manner on the opening of the reservoir, and an actuator rod (32*a*, 32*b*) that is axially movable down and up along an axis X over a stroke; a pusher (9) that is axially movable down and up along an axis Y so as to move said at least one actuator rod (32*a*, 32*b*) axially; and the dispenser being characterized in that it further comprises stroke-variation means (8) for varying the stroke of the actuator rod, said means being disposed between the pusher (9) and said at least one actuator rod (32*a*, 32*b*), so as to vary the stroke of the stem.

13 Claims, 5 Drawing Sheets

Figure 1:
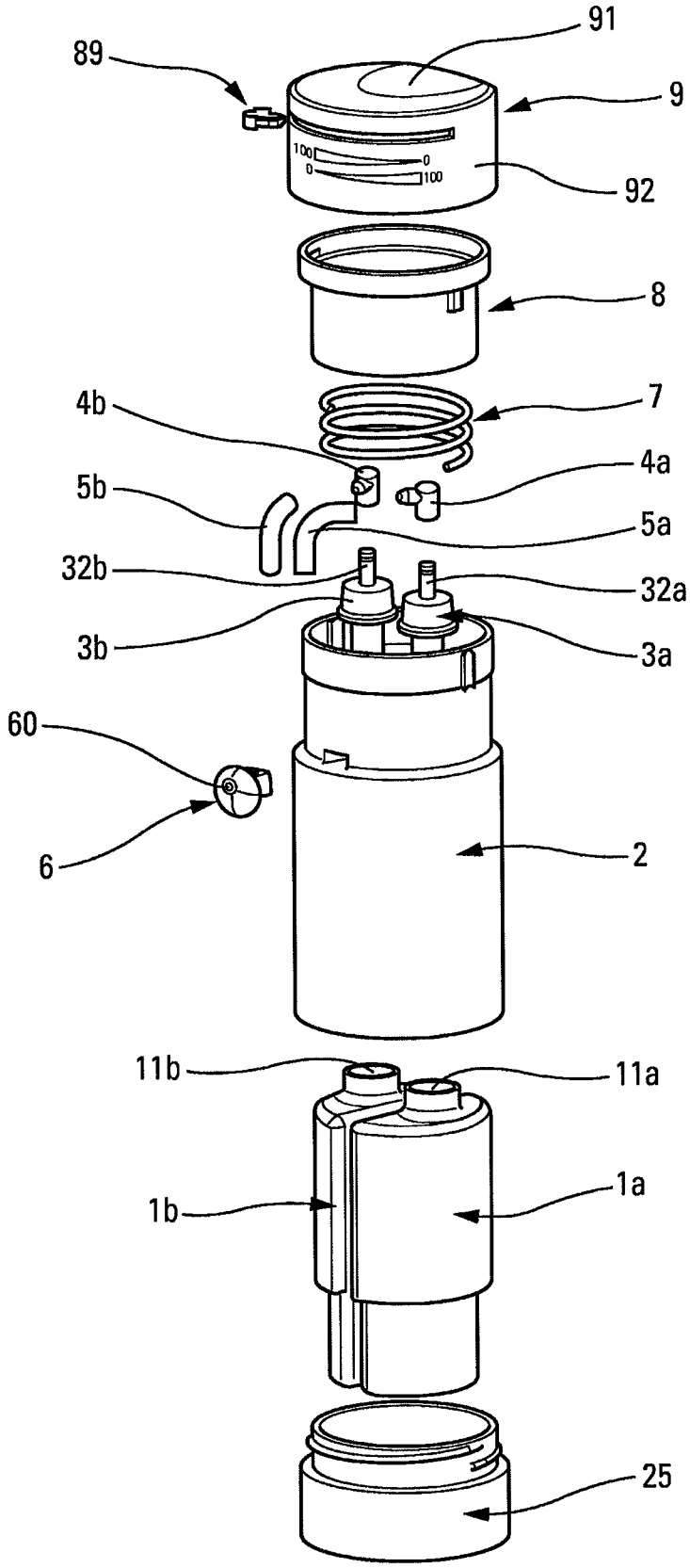

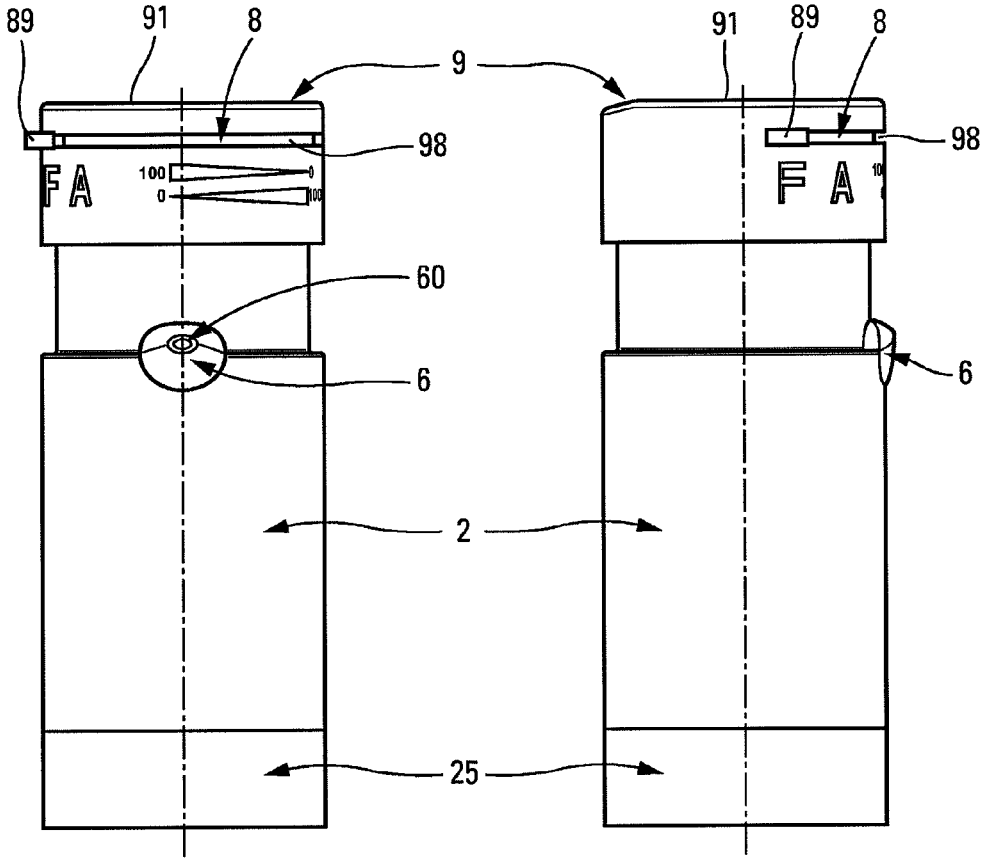
Fig. 2a
Fig. 2b
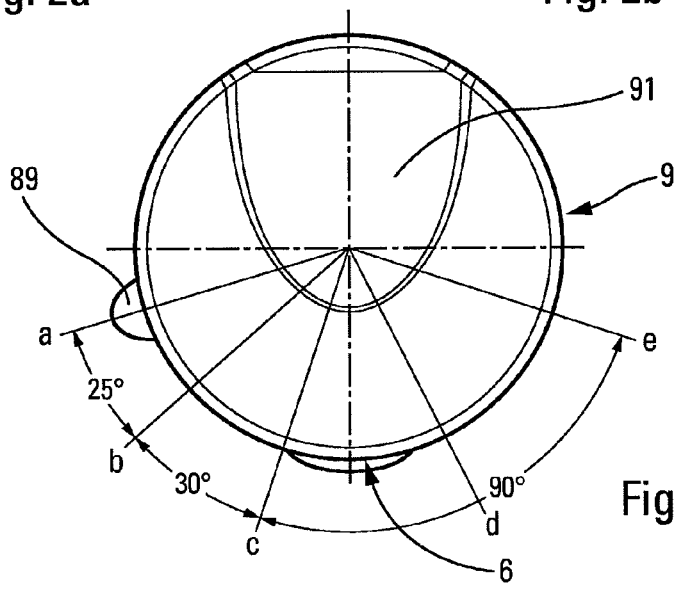
Fig. 3

FLUID PRODUCT DISPENSER

The present invention relates to a fluid dispenser comprising at least one fluid reservoir, at least one fluid dispenser member, such as a pump or a valve, and a pusher that is axially movable down and up so as to actuate the dispenser member(s). Such fluid dispensers are frequently used in the fields of perfumery, cosmetics, or even pharmacy.

In conventional manner, a pump or a valve comprises a body for mounting in stationary manner in or on an opening of a reservoir, and an actuator rod that is axially movable down and up along an axis over a certain stroke. At rest, the actuator rod is extended to its maximum outside the body under the action of a spring housed inside the body. From this extended rest position, the rod can be depressed to a low position defined by the internal configuration of the body. The stroke of the actuator rod is thus defined between the extended position and the depressed position. In general, when a pump or a valve is actuated, the actuator rod moves over its entire stroke. As a result, a constant and complete dose of fluid is dispensed.

An object of the present invention is to vary the quantity of fluid that is dispensed each time the dispenser member is actuated.

To do this, the present invention proposes a fluid dispenser comprising: at least one fluid reservoir provided with an opening; at least one fluid dispenser member, such as a pump or a valve, comprising a body that is mounted in stationary manner on the opening of the reservoir, and an actuator rod that is axially movable down and up along an axis X over a stroke; a pusher that is axially movable down and up along an axis Y so as to move said at least one actuator rod axially; said dispenser being characterized in that it further comprises stroke-variation means for varying the stroke of the actuator rod, said means being disposed between the pusher and said at least one actuator rod, so as to vary the stroke of the stem. The invention applies to a dispenser having only one reservoir and only one dispenser member, but it also applies to a dispenser of the dual type including two reservoirs and two dispenser members that can be actuated by a single pusher or by two respective pushers. The present invention thus makes provision for modifying the stroke of the actuator rod so as to dispense incomplete doses of fluid.

According to an advantageous characteristic of the invention, the variation means comprise at least one movable bearing path that is adapted to bear directly or indirectly against said at least one actuator rod, the path defining axially-offset bearing zones that can, by moving the path, be positioned axially above said at least one actuator rod. Advantageously, the stroke-variation means comprise a rotary ring that turns about an axis Z that is parallel to, or coincides with, the axis Y, the ring turning about said at least one actuator rod. Advantageously, the rotary ring is received in the pusher that does not move relative to said at least one actuator rod. Preferably, said at least one path extends in a circular arc centered on the axis Z. In a variant, said at least one path is rectilinear. In an embodiment, the path slopes in such a manner as to form a ramp. In a variant, the path is stepped in such a manner as to form a riser that is axially offset. The bearing path that is movable in turning or in translation, constitutes a force-transmission part for transmitting force between the pusher and the actuator rod(s). By means of the axially-offset zones that can be positioned above the actuator rod(s) selectively by moving the bearing path, it is possible to depress the actuator rod(s) to a greater or lesser extent when the pusher is actuated.

In an advantageous aspect of the invention, the ring includes an actuator member that is accessible through a window formed by the pusher. The ring can thus be turned inside the pusher, thereby moving the bearing path(s), and positioning determined axially-offset zones immediately above the actuator rod(s).

According to another characteristic of the invention, the ring includes locking means that are adapted to block the pusher at rest. In the locking position, the ring is not used as a force-transmission part for transmitting force between the pusher and the actuator rod(s), but for transmitting force between the pusher and a stationary portion of the dispenser.

In an advantageous embodiment of the invention, the device comprises two reservoirs, two dispenser members, a pusher, and two respective bearing paths for the two actuator rods. Advantageously, the axially-offset bearing zones of the paths extend with axial slopes that are generally opposite, so that the strokes of the two rods vary in opposite manners while the pusher is being actuated. Thus, by actuating the pusher, it is possible to act differently on the two dispenser members of the dispenser. For example, it is possible to actuate one dispenser member fully, and the other not at all, and vice versa. It is also possible to move the actuator rod of one dispenser member over 75% of its stroke, and the actuator rod of the other dispenser member over 25% of its stroke. This depends on the design and on the configuration of the bearing paths.

In a practical embodiment, the bearing paths are formed by a rotary ring that turns about an axis Z that extends mid-way between the two axes X of the actuator rods, the paths extending in circular arcs centered on the axis Z. In a variant, the bearing paths are formed by a slider that is movable in translation perpendicularly to the axes X. In the version that is movable in turning, the two paths are disposed end to end around a single circle. In the version that is movable in translation, the two paths are disposed end to end or parallel to each other.

An advantageous principle of the invention is to interpose a part between the pusher and the actuator rod(s), said part serving as a force-transmission part that is capable of varying the stroke(s) of the rod(s). To do this, it is necessary for the part to be movable, either in turning, or in translation. In this way, it can depress the actuator rod(s) to a greater or lesser extent.

The invention is described more fully below with reference to the accompanying drawings which show an embodiment of the invention by way of non-limiting example.

Figure 4B:
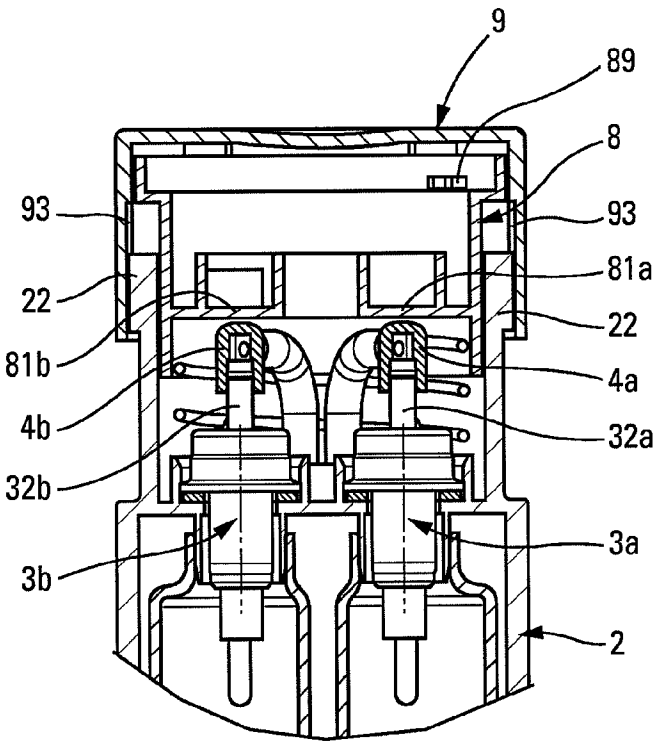
Figure 4A:
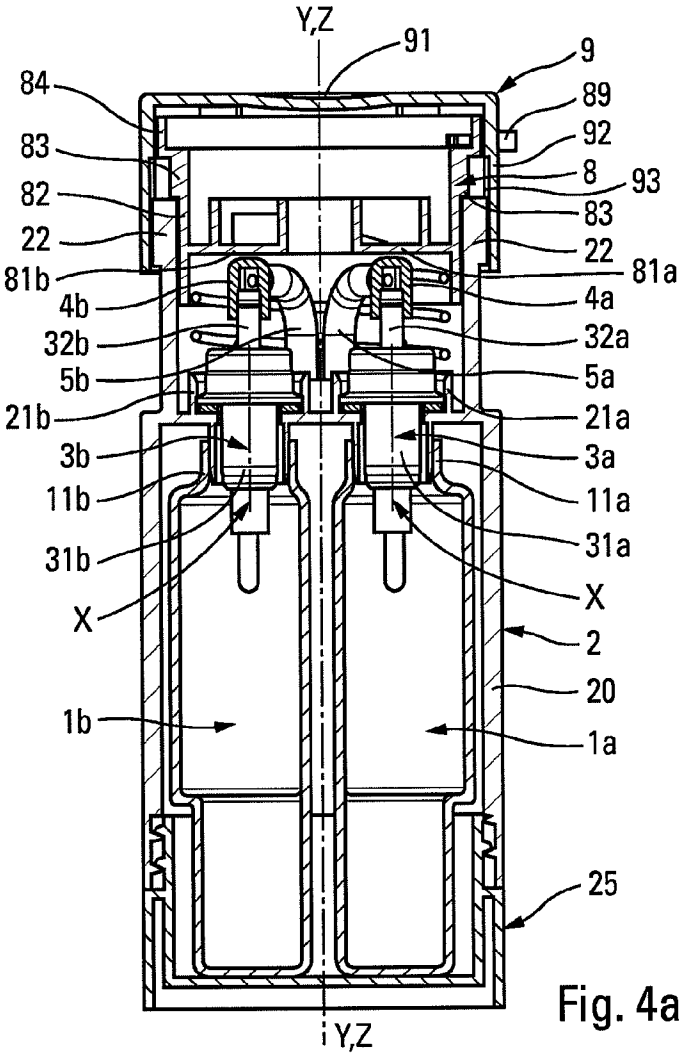
Figure 4D:
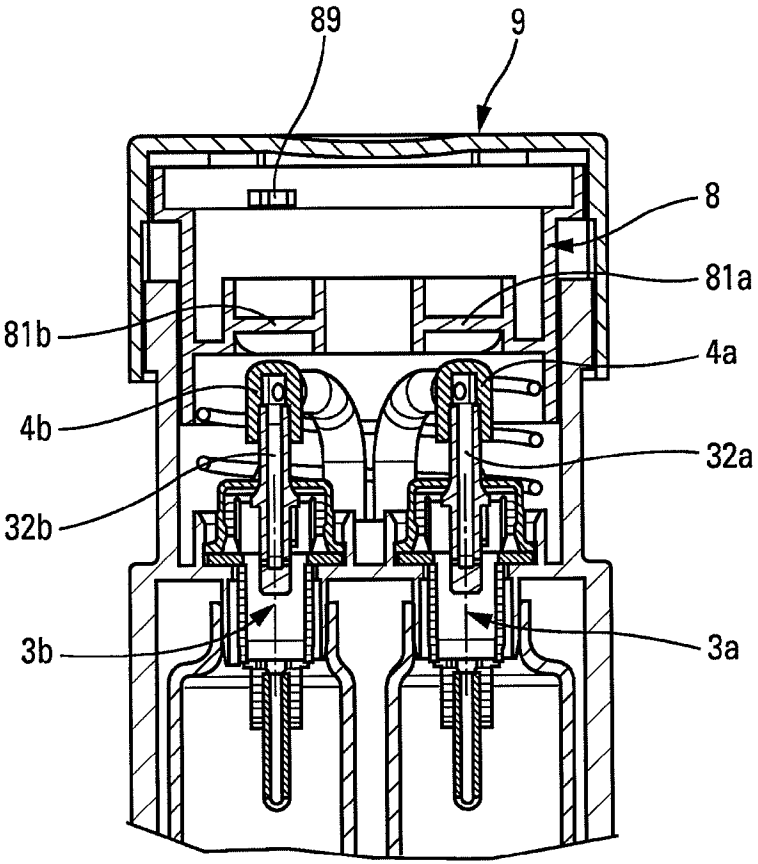
Figure 4C:
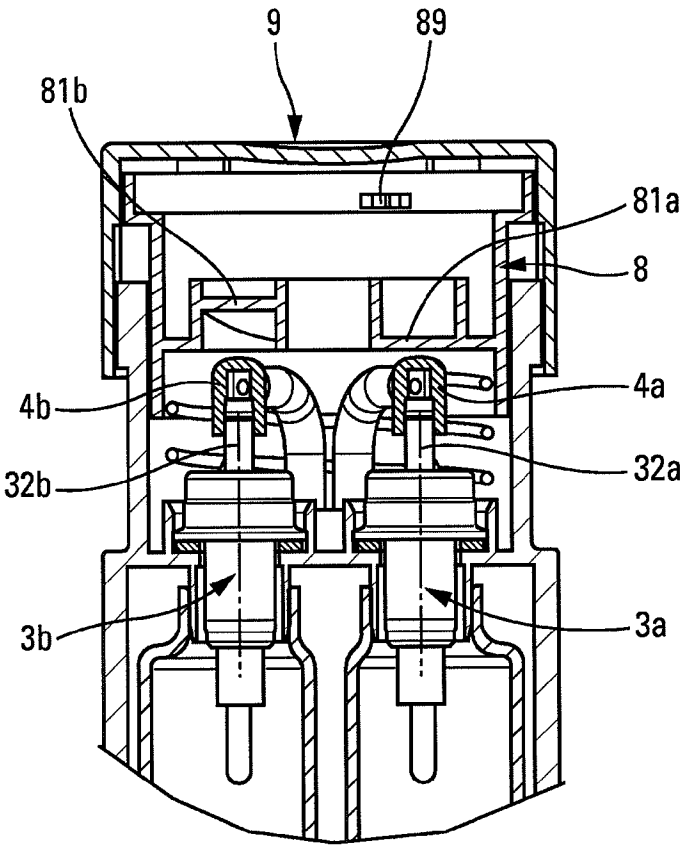
Figure 5:
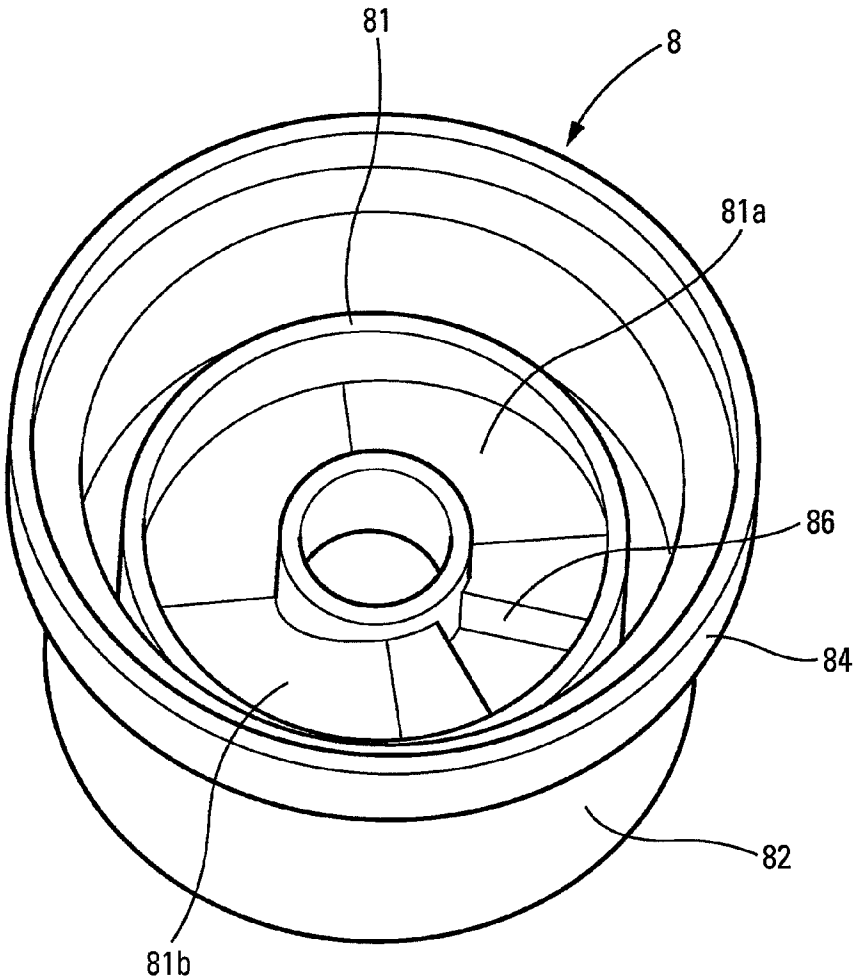

In the figures:

FIG. 1 is an exploded perspective view of a fluid dispenser of the invention;

FIGS. 2*a* and 2*b* are front and profile views respectively of the FIG. 1 dispenser in its assembled state;

FIG. 3 is a plan view of the FIG. 2*a* dispenser;

FIGS. 4*a*, 4*b*, 4*c*, 4*d*, and 4*e* are vertical-section views through the dispenser in FIGS. 1 to 3 in different dose-variation configurations; and FIG. 5 is a perspective view showing the inside of the rotary ring.

Reference is made firstly to FIGS. 1 to 4*a* in order to describe in detail the structure of a fluid dispenser constituting an embodiment of the invention. In the embodiment used to illustrate the present invention, the fluid dispenser is a "duo-type" dispenser including two reservoirs 1*a* and 1*b*, and two dispenser members 3*a* and 3*b*. In this embodiment, the dispenser members are pumps, but it is also possible to use valves. The present invention is thus applied to a duo dispenser, but it can also be applied to a more conventional dispenser including only one reservoir and a single dispenser member. In this document, it has been chosen to describe the invention in a duo dispenser, since such a configuration brings additional advantages compared to a conventional dispenser with a single reservoir and a single dispenser member. In particular, it is possible to vary the strokes of the two rods differently.

In FIG. 1, it can be seen that the dispenser comprises fourteen component elements, namely: two fluid reservoirs 1*a* and 1*b*; a covering shell 2 made of two portions; two dispenser members 3*a* and 3*b* that are pumps in this embodiment; two connection sleeves 4*a* and 4*b*; two flexible ducts 5*a* and 5*b*; a dispenser endpiece 6 forming a dispenser orifice 60; a return spring 7; dose-variation means 8 that are in the form of a rotary ring; and a common pusher 9 on which the user can press so as to actuate the dispenser.

The two reservoirs 1*a* and 1*b* are preferably made of plastics material and advantageously they present cross-sections that are half-moon shaped. Thus, disposed in adjacent manner, the two reservoirs are inscribed in a cylinder. Each reservoir includes an opening 11*a*, 11*b* that is defined by a neck. Instead of the half-moon reservoirs, it is possible to use other reservoirs having different shapes.

The external covering shell 2 defines a main cylinder 20 that is extended upwards by a turret 22. Internally, the shell 2 forms two reception housings 21*a* and 21*b* for receiving the dispenser members, as described below. At its bottom end, the shell is provided with a bottom wall 25 that is screw fastenable in this embodiment. The reservoirs 1*a* and 1*b* are disposed inside the shell 2 with their respective openings 11*a* and 11*b* disposed in the proximity of the reception housings 21*a*, 21*b*, as can be seen in FIG. 4*a*. The shell 2 is preferably made of plastics material, as is the bottom 25. However, other materials can be used.

The dispenser members 3*a* and 3*b* are pumps, each comprising a pump body 31*a*, 31*b* inside which an actuator rod 32*a*, 32*b* is axially movable down and up along axes X that are parallel in this embodiment. The actuator rods 32*a*, 32*b* are urged into their rest position by respective springs housed inside the body 31*a*, 31*b*. In their rest position, the rods 32*a*, 32*b* are extended to their maximum outside their respective body. By exerting axial pressure on the rods, said rods can be moved against internal springs (not shown) to an extreme low position. Thus, each actuator rod can be moved over a determined stroke between a high rest position and a low depressed position. This characteristic is entirely conventional for a conventional dispenser member, whether a pump or a valve. Pumps 3*a* and 3*b* are received in stationary manner in the reception housings 21*a*, 21*b* formed by the shell 2. Fastening can advantageously be achieved by snap-fastening the body 31*a*, 31*b* inside the housings 21*a*, 21*b*. Consequently, the bodies of the pumps are mounted in stationary manner relative to the reservoirs 1*a*, 1*b* and relative to the shell 2. In contrast, the rods 32*a*, 32*b* are axially movable along the respective axes X.

In the embodiment shown in the figures, each actuator rod is covered by a connection sleeve 4*a*, 4*b* that is engaged in leaktight manner on the free end of the rod. The connection sleeves 4*a*, 4*b* form an angle relative to the axes X. Each sleeve is connected to a flexible connection hose 21*a*, 21*b* that is capable of deforming when the respective rod is moved axially. The two flexible hoses are connected to a dispenser endpiece 6 that is mounted in stationary manner on the shell 2, as can be seen in FIGS. 1, 2*a*, 2*b*, and 3. In other words, the connection sleeves 4*a*, 4*b* are axially movable, whereas the dispenser endpiece 6 is stationary. The flexible connection hoses 21*a*, 21*b* make it possible to connect the sleeves in fluid-flow manner to the endpiece while enabling the actuator rods to be moved axially. The sleeves 4*a*, 4*b*, the flexible hoses 21*a*, 21*b*, and the dispenser endpiece 6 are made from separate parts in this embodiment. However, it is possible to make all of the parts as a single piece by molding the flexible hoses 21*a*, 21*b* onto the sleeves and the dispenser endpiece. Dual injection molding with different materials is advantageous, since the sleeves and the endpiece need to be substantially rigid, whereas the hoses need to present good flexibility.

Figure 4E:
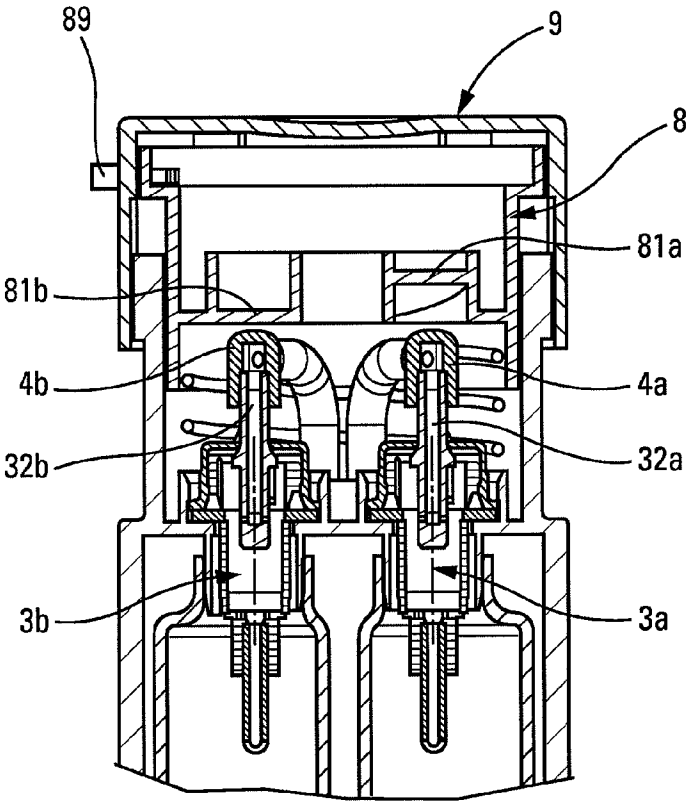

In the invention, the dispenser is also provided with variation means 8 making it possible to vary the stroke of the actuator rods in such a manner as to dispense varying doses of fluid. In this embodiment, the variation means are in the form of a rotary ring 8 that is adapted to turn about an axis Z that advantageously extends parallel to the axes X. The axis Z preferably extends mid-way between the axes X and in the same plane. In other words, the axis Z passes between the two actuator rods 32*a*, 32*b*. The ring 8 includes a bottom bushing 82 that is engaged inside the turret 22 formed by the shell 2. However, the ring 8 is free to turn inside the turret 22 about the axis Z. Above the bushing 82, the ring forms a shoulder 83 that serves as anti-turning means by coming to bear against the top end of the turret 22 when the dispenser is in its rest position, as shown in FIG. 4*a*. Above the shoulder 83, the ring forms a crown 84 that is provided with an actuator member 89 that, in this embodiment, is in the form of a small button that can be held by means of one or two fingers. Internally, the ring 8 forms an annular track 81 that is visible in FIG. 5. The track 81 defines two bearing paths 81*a* and 81*b* for coming into contact with the actuator rods 32*a*, 32*b*, or more precisely with the connection sleeves 4*a*, 4*b* mounted on the ends of the rods. According to an advantageous characteristic of the invention, the bearing paths 81*a*, 81*b* define bearing zones that are situated at different axial heights. In order to bring the zones immediately above the actuator rods axially, it suffices to turn the ring 8 about the axis Z. In the embodiment shown in the figures, the paths define bearing zones in the form of sloping ramps and horizontal steps. This is visible in FIG. 5. As a result, by turning the ring 8, the distances separating the bearing paths from the connection sleeves vary. This can be seen by comparing FIGS. 4*a* and 4*e*. In the locked rest position shown in FIG. 4*a*, the two paths 81*a* and 81*b* define two horizontal plane steps that are situated at the same axial level. The paths are practically in contact with the sleeves 4*a*, 4*b*. In FIG. 4*b*, the ring 8 has been turned a little, through approximately 25°, by manipulating the button 89. The shoulder 83 is no longer situated above the end of the turret 22, but the bearing paths 81*a* and 81*b* remain at the same axial level as in FIG. 4*a*. On continuing to turn, as shown in FIG. 4*c*, the bearing path 81*b* moves away from the sleeve 4*b*, whereas the bearing path 81*a* remains at the same level as in FIGS. 4*a* and 4*b*. In order to pass to the axial level shown in FIG. 4*c*, the bearing path 81*b* forms a vertical riser 86, visible in FIG. 5. Consequently, at least one point along the bearing path is a combination of a sloping ramp, a horizontal flat, and a vertical riser. On continuing to turn, as shown in FIG. 4*d*, the two bearing paths are situated once again at the same axial height, but at a distance from the connection sleeve that is greater than the distance in FIGS. 4*a* and 4*b*. By moving the button once again and as far as possible, as shown in FIG. 4*e*, the opposite configuration to that of FIG. 4*c* is reached, i.e. with the bearing path 81*b* in the proximity of the connection sleeve 4*b*, and the bearing path 81*a* at a maximum distance from its connection sleeve 4*a*. It should thus be understood that turning the ring about its axis Z causes the axially-offset bearing zones of the paths to be brought immediately above the connection sleeves 4*a* and 4*b*, i.e. immediately above the actuator rods 32*a*, 32*b*.

The pusher 9 includes a bearing surface 91 on which the user can press by means of one or more fingers, so as to move the pusher axially down and up along an axis Y that coincides with the axis Z of the ring 8 in this embodiment. The pusher 9 also includes a substantially-cylindrical peripheral skirt 92 that is provided internally with axial grooves 93 that are engaged with corresponding splines formed on the turret 22. Thus, the pusher 9 is prevented from turning on the shell 2, and consequently relative to the actuator rods 32*a*, 32*b*. The skirt 92 of the pusher forms an elongate window 98 that extends over nearly 150° in this embodiment. The window is clearly visible in FIGS. 2*a* and 2*b*. The actuator member 89 that is secured to the ring extends through the window 98 and can be moved along the window in such a manner as to turn the ring 8 inside the pusher 9 that is itself prevented from turning. The crown 84 of the ring 8 is engaged inside the skirt 93 of the pusher, without said crown being prevented from turning. The actuator member 89 is connected to the crown 84.

Thus, by actuating the member 89 of the ring 8, it is possible to vary the axial distances between the bearing zones and the paths situated immediately above the connection sleeves. With reference once again to FIG. 4*a*, it can easily be understood that the pusher 9 is blocked in axial movement as a result of the shoulder 83 of the ring resting on the turret 22. It is thus impossible to depress the pusher 9. The bearing zones of the paths situated immediately above the sleeves thus cannot come to bear against their respective sleeves and move the actuator rods. The actuator member 89 is thus in the position in FIG. 3. On moving it through 25°, position b is reached as shown in FIG. 4*b*. The bearing zones of the paths remain at the same axial heights. In contrast, the shoulder 83 no longer prevents the pusher from being actuated. In this position, it is possible to move the pusher 9 that entrains the ring 8 so that the bearing zones of the paths situated above the sleeves come into contact with the sleeves and thus depress the actuator rods 32*a*, 32*b*. Given that the bearing zones are in the direct proximity of the sleeves in the rest position of the pusher, the actuator rods are actuated over their entire stroke. Each pump thus dispenses a complete dose, i.e. 100%. On continuing to move the actuator member 89 through approximately 30%, position c in FIG. 3 is reached, corresponding to FIG. 4*c*. The bearing zone of the path 81*b* moves axially upwards so that it is at a maximum distance from the sleeve 4*b*. The bearing zone of the path 81*a* remains at the same axial height as for positions a and b. On actuating the pusher 9, the path 81*a* comes into contact with the sleeve 4*a* immediately, and depresses the rod 32*a*. In contrast, the path 81*b* does not come into contact with the sleeve 4*b*, or else only comes into contact at the very end of the stroke. Consequently, the pump 3*a* dispenses a complete dose, whereas the pump 3*b* dispenses nothing at all. At the dispenser endpiece 6, the user collects a quantity of fluid that corresponds to 100% of a dose from the pump 3*a*, and to 0% of a dose from the pump 3*b*. On continuing to move the actuator member 89 through approximately 45°, position d in FIG. 3 is reached, corresponding to FIG. 4*d*. The bearing zones of the paths 81*a*, 81*b* are disposed once again at the same axial height, but at a distance from their sleeves that is situated mid-way between the positions in FIG. 4*c*. By pressing on the pusher 9, the bearing paths firstly start to move closer to their corresponding sleeves. By continuing to press on the pusher 9, the bearing paths thus come into abutment against their respective sleeves, and move the actuator rods over an incomplete stroke. As a result, the pumps 3*a* and 3*b* dispense incomplete doses, e.g. corresponding to half a dose. At the dispenser endpiece, the user collects a quantity of fluid that corresponds to 50% of a complete dose from the pump 3*a*, and to 50% of a complete dose from the pump 3*b*. On moving the actuator member once again, position e in FIG. 3 is reached, corresponding to FIG. 4*e*. In this position, the path 81*b* is in the direct proximity of the sleeve 4*b*, whereas the path 81*a* is at a maximum distance from the sleeve 4*d*. This is the opposite position to that in FIG. 4*c*. By actuating the pusher 9, the pump 3*a* dispenses nothing at all, whereas the pump 3*b* dispenses a complete dose. The user thus collects a quantity of fluid that corresponds to 100% of the complete dose from the pump 3*b*, and to 0% of the complete dose from the pump 3*a*.

The ring 8 fulfils a function of transmitting force between the pusher 9 and the actuator rods. This force-transmission part is used to come into contact with the actuator rods, or more precisely with the connection sleeves mounted on the rods. The bearing paths 81*a* and 81*b* are preferably oriented with slopes that are generally opposite, so as to be able to vary the doses from the pumps in opposite manners, i.e. with one pump emitting 0% to 100% of its complete dose, for the other pump emitting from 100% to 0% of its complete dose. This is possible by means of the rotary ring 8 that includes two bearing paths that are disposed in a circular arc on a single track 81, each path extending over substantially half of the track. The axis of rotation of the paths is the axis Z that coincides with the axis Y of the pusher in this embodiment.

Although the drawings show a dispenser that incorporates stroke-variation means in the form of a rotary ring, it is also possible to provide stroke-variation means that move in translation perpendicularly to the axes X of the actuator rods. It is possible to imagine a slider defining two bearing paths disposed side by side and movable perpendicularly to the axes X, so as to bring axially-offset bearing zones of the paths immediately above the actuator rods of the pumps. In this event, the bearing paths are rectilinear and advantageously disposed in parallel manner. It is also possible to have the two paths in a single line, one behind the other.

By means of the present invention, it is possible to vary the dose of fluid dispensed, by acting on the stroke of the actuator rods.

The invention claimed is:

1. A fluid dispenser comprising:

at least one fluid reservoir provided with an opening;

at least one fluid dispenser member that is a pump, comprising a body that is mounted in stationary manner on the opening of the reservoir, and an actuator rod that is axially movable down and up along an axis X over a stroke;

a pusher that is axially movable down and up along an axis Y so as to move said at least one actuator rod axially; and a stroke-variation mechanism that varies the stroke of the actuator rod so as to dispense one or more varying doses of fluid between no stroke that delivers no dose and a maximum stroke that delivers a maximum dose, said stroke-variation mechanism disposed between the pusher and said at least one actuator rod;

the stroke-variation mechanism comprises at least one movable bearing path that is adapted to bear against said at least one actuator rod, the path defining axially-offset bearing zones that can, by moving the path, be positioned axially above said at least one actuator rod;

the stroke-variation mechanism further comprises a rotary ring that turns about an axis Z that is parallel to, or coincides with, the axis Y, the ring turning about the at least one actuator rod.

2. A device according to claim 1, in which the rotary ring is received in the pusher that does not move relative to said at least one actuator rod.

3. A device according to claim 1, in which said at least one path extends in a circular arc centered on the axis Z.

4. A device according to claim 1, in which the path slopes in such a manner as to form a ramp.

5. A device according to claim 1, in which the path is stepped in such a manner as to form a riser that is axially offset.

6. A device according to claim 1, in which the ring includes an actuator member that is accessible through a window formed by the pusher.

7. A device according to claim 1, in which the ring includes locking means that are adapted to block the pusher at rest.

8. A device according to claim 1 comprising two reservoirs, two dispenser members, a pusher, and two respective bearing paths for the two actuator rods.

9. A device according to claim 8, in which the axially-offset bearing zones of the paths extend with axial slopes that are generally opposite, so that the strokes of the two rods vary in opposite manners while the pusher is being actuated.

10. A device according to claim 8, in which the bearing paths are formed by the rotary ring that turns about the axis Z that extends mid-way between the two axes X of the actuator rods, the paths extending in circular arcs centered on the axis Z.

11. The device according to claim 1, wherein the at least one fluid dispenser member is a pump or a valve.

12. A fluid dispenser comprising:

at least one fluid reservoir comprising an opening;

at least one fluid dispenser member that is a pump comprising a body mounted in stationary manner on the opening of the reservoir, and an actuator rod axially movable down and up along an axis X over a stroke;

a pusher axially movable down and up along an axis Y so as to move the at least one actuator rod axially;

means for varying the stroke of the actuator rod so as to dispense one or more varying doses of fluid between no stroke that delivers no dose and a maximum stroke that delivers a maximum dose, the means for varying the stroke of the actuator rod disposed between the pusher and the at least one actuator rod;

the means for varying the stroke of the actuator rod is rotatable at least in part about an axis Z parallel to, or coinciding with, the axis Y.

13. The fluid dispenser according to claim 12, wherein the means for varying the stroke of the actuator rod comprises bearing paths at different heights in the Y axis direction and configured to be selectively positioned above the actuator rod, each bearing path defining a different stroke length of the actuator rod.

* * * * *